United States Patent [19]

Dhanjal

[11] Patent Number: 4,949,093

[45] Date of Patent: Aug. 14, 1990

[54] COMPACT ANTENNA RANGE WITH SWITCHABLE ELECTROMAGNETIC MIRROR

[75] Inventor: Sutinder S. Dhanjal, Hamilton Township, Mercer County, N.J.

[73] Assignee: General Electric Company, East Windsor, N.J.

[21] Appl. No.: 155,412

[22] Filed: Feb. 12, 1988

[51] Int. Cl.[5] ..... H01Q 19/10

[52] U.S. Cl. ..... 343/755; 343/909

[58] Field of Search ..... 343/755, 754, 753, 781 P, 343/703, 909

[56] References Cited

U.S. PATENT DOCUMENTS

| | | | |
|---|---|---|---|
| 2,677,056 | 4/1954 | Cochrane et al. | 343/755 |
| 2,736,895 | 2/1956 | Cochrane | 343/755 |
| 3,166,748 | 1/1965 | Shanks et al. | 343/100 |
| 3,259,902 | 7/1966 | Malech | 343/753 |
| 3,302,205 | 1/1967 | Johnson | 343/703 |
| 3,649,934 | 3/1972 | Matthaei et al. | 343/755 |
| 3,662,389 | 4/1972 | Coffin et al. | 343/100 AP |
| 3,732,569 | 5/1973 | Collins | 343/100 |
| 3,825,931 | 7/1974 | Gonzalez et al. | 343/100 AP |
| 3,879,733 | 4/1975 | Hansen et al. | 343/100 AP |
| 4,090,204 | 5/1978 | Farhat | 343/754 |
| 4,358,771 | 11/1982 | Hsieh | 343/754 |
| 4,553,145 | 11/1985 | Evans | 343/360 |
| 4,675,628 | 6/1987 | Rosen | 333/164 |
| 4,677,393 | 6/1987 | Sharma | 333/137 |
| 4,689,631 | 8/1987 | Gans et al. | 343/777 |

FOREIGN PATENT DOCUMENTS

| | | | |
|---|---|---|---|
| 0599612 | 5/1980 | U.S.S.R. | 343/703 |

OTHER PUBLICATIONS

"Microwaves and RF" magazine, vol. 26, No. 5, May 1987; Compact Ranges Get Radar Cross-Section Data Abundance (pp. 118-130).

"Microwaves and RF" magazine, vol. 26, No. 5, May 1987; Compact Range Technology and the Marketplace (pp. 135-138).

"Microwaves and RF" magazine, vol. 26, No. 5, May 1987; Better RCS Data with Anechoic Absorber Characterization (pp. 143-152).

"Microwaves and RF" magazine, vol. 26, No. 5, May 1987; Troubleshooting Limitations in Indoor RCS Measurements (pp. 154-163).

"Microwave and RF" magazine, vol. 26, No. 5, May 1987; Dual Chamber Design Reduces Quiet Zone Ripple/Taper Errors (pp. 168-174).

"Microwaves and RF" magazine, vol. 26, No. 5, May 1987; Prime Focus Feed Key to Operation of Largest Range (pp. 181-183).

"Antennas" by Kraus, published by McGraw-Hill, 1950, pp. 447-453.

"Antenna Engineering Handbook", by Jasik, pp. 34-15 to 34-19.

An article entitled "New Compact Antenna Range to Test Larger Aircraft, Higher Frequencies" by Nordwall, published at pages 77 and 79 of Aviation Week and Space Technology, Dec. 5, 1988.

*Primary Examiner*—William L. Sikes
*Assistant Examiner*—Robert E. Wise
*Attorney, Agent, or Firm*—William H. Meise

[57] ABSTRACT

A compact electromagnetic antenna pattern range includes a planar reflector which is controllable between a reflective condition and a transmissive condition. The controllable reflector is placed parallel to a second planar reflector, and a pulse of electromagnetic energy is injected into the space between the reflectors, propagating toward one of the reflectors. After a number of re-reflections, the controllable reflector is rendered transmissive and a substantially planar wavefront is made available for application to the antenna under test.

20 Claims, 4 Drawing Sheets

FIG. 2c
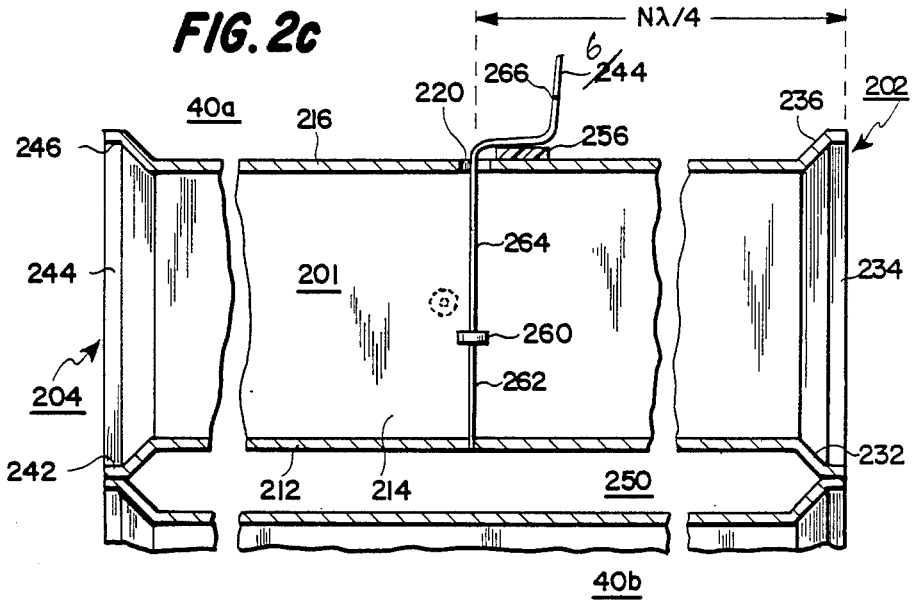
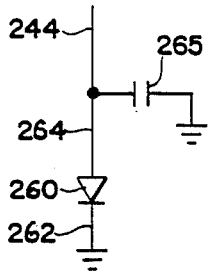
FIG. 2d
FIG. 3
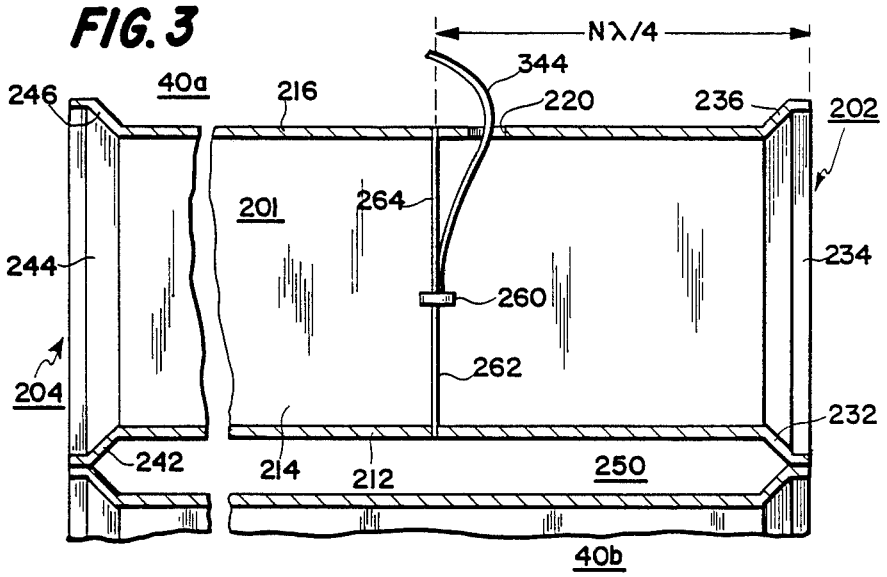

18
26
28
OSC
510
PULSE DURATION TIMER
512
TRANSMITTER 24
590
20
S
40
44
43
SWITCH DRIVER
520
FF
S
R
518
PULSE REFLECTION TIMER
516
522
RECURRENCE TIMER
514
CONTROL UNIT 42
AUT
30
34
RECEIVER
PATTERN RECORDER
38

CONTROL UNIT
42
44
444a
444b
444y
444z
446a
446b
446y
40a
40b
40y
40z

COMPACT ANTENNA RANGE WITH SWITCHABLE ELECTROMAGNETIC MIRROR

This invention relates to compact ranges for the testing of antennas in which a plane electromagnetic wave is generated by multiple reflections.

Electromagnetic antennas are used for propagating electromagnetic signals between transmitting and receiving locations by means of the space therebetween. For some purposes, such as radar sets and earth station communications antenna, the antennas must be highly directive. For other purposes, as for example surveillance or electromagnetic leakage testing, the antennas should be omnidirectional. When antennas are initially designed, or when they are constructed at the factory, it may be desirable to perform tests to determine their directive or gain characteristics.

A common method for testing the directive characteristics of antennas is to mount the antenna under test (AUT) on a rotatable platform, and to direct an electromagnetic field of appropriate polarization and frequency toward the AUT. A receiver connected to the AUT produces an electrical signal in response to the received signal amplitude, and couples the electrical signal to a chart recorder which is synchronized with the rotation of the AUT. The recorder produces a plot of the received amplitude as a function of azimuth, which is related to the directivity and gain.

Those skilled in the art know that antennas are passive elements, and that the gain and directional characteristics are reciprocal or equal regardless of whether the antenna is transmitting or receiving energy. Thus, a test of the AUT in a receiving mode yields results which are equally applicable to a transmitting mode.

It is well known that the apparent directional characteristics of the antenna as plotted on a recorder may change depending upon whether the electromagnetic field impinging upon the antenna is essentially plane or spherical. An electromagnetic field expanding into space from a point source is spherical. At large distances from the point source, however, a small portion of the wavefront is essentially planar. It is ordinarily assumed that a planar wavefront will be received by an antenna in ordinary operation. When the antenna is tested, therefore, the impinging field should be essentially planar. Rules-of-thumb have arisen to limit the amount of spherical aberration of the impinging wavefront across the aperture of the antenna under test. The aberration is expressed as the relative phase shift of the wavefront at the aperture, which is often limited to $\lambda/10$, or sometimes $\lambda/16$. The rule-of-thumb is sometimes expressed as $$R \geqq 2^2/\lambda \quad (1)$$

where R is the distance between the AUT and the antenna producing the field which impinges upon the AUT, d is the aperture of the AUT, and $\lambda$ is the wavelength at the operating frequency.

The advent of large-diameter reflecting-type antennas for ground-to-air communications and for radio astronomy has resulted in requirements for extremely large separations between the transmitting antenna and the AUT during directivity determinations. When the path lengths are very long, further problems arise in determining the directivity, because of the effects of multiple reflections of the test electromagnetic wave from the ground and from surrounding structures of the antenna testing range. As a result of the enormous cost of large antenna test ranges, and also because of the inaccuracies arising from multiple reflections, compact ranges or so-called "RF darkrooms" have come into increasing use. The walls of the RF darkroom are covered with RF absorbing material to eliminate reflections. Test electromagnetic waveforms are generated by directing energy toward curved reflectors shaped to generate a plane wave front at the location of the antenna under test, as described in detail in a series of articles entitled "Technology Closeup-Compact Ranges", published at pages 117–183 of *Microwaves and RF* magazine, Vol. 26, No. 5, May 1987. The reflectors required tend to have edge effects which decrease the phase accuracy of the wavefront of the test wave, as a result of which they are made much larger than would be necessary if the edge effects were not present, in order to be able to place the antenna under test in a portion of the field which is substantially plane. Furthermore, the curved reflectors are expensive to manufacture and are themselves difficult to test for conformity to their design criteria.

A compact range is desired in which the substantially plane wave is generated by reflectors having a configuration which is readily tested.

SUMMARY OF THE INVENTION

An arrangement for producing a substantially plane electromagnetic wavefront includes first and second mutually parallel spaced apart plane electromagnetic reflectors. An arrangement is provided for introducing electromagnetic energy into the region between the spaced-apart first and second reflectors. One of the reflectors is controllable between the reflecting condition and a transmissive condition.

DESCRIPTION OF THE DRAWING

FIGS. 2*a*, 2*b* and 2*c*, referred to jointly as FIG. 2, illustrate details of a reflector of the arrangement of FIG. 1 which is capable of switching between a reflective and transmissive condition by voltage bias of a diode, and FIG. 2*d* is a schematic representation of a diode illustrated in FIG. 2*c;*

FIG. 3 illustrates an arrangement for energizing a diode by means of light;

DETAILED DESCRIPTION OF THE INVENTION

Figure 1:
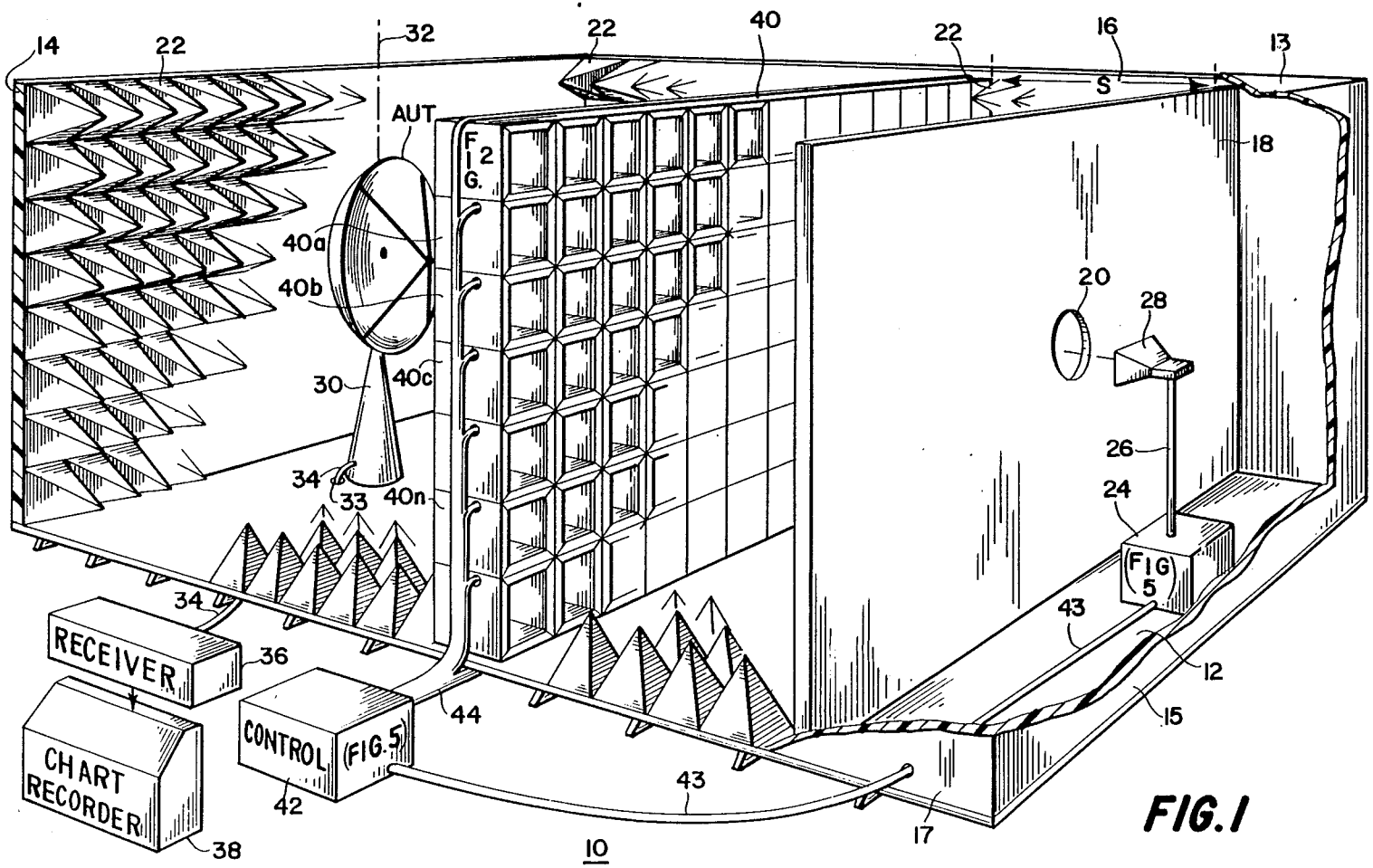
FIG. 1 is a perspective or isometric view, partially cut away, of a compact antenna test range according to the invention.

FIG. 1 illustrates, in perspective or isometric view, a compact antenna test range 10 in accordance with the invention, in which portions of the exterior walls have been cut away to illustrate interior details. Compact range 10 is formed as a room with a floor 12, a back wall 14, and a side wall 16. The ceiling 13, end wall 15, and the other side wall 17 are shown as being partially cut away. A conductive plate 18 defining a central aperture 20 extends from wall 16 across to wall 17, and from floor 12 to ceiling 13, and constitutes a plane electromagnetic mirror. Conductive plate 18 may be a thin copper sheet supported on the near side by a wooden frame structure (not illustrated). The floor, walls, and ceiling in the region between back wall 14 and conductive plate 18 are covered in known fashion with electromagnetic energy absorbing material which may be in the form of pyramids, one of which is illustrated as 22. A controllable transmitter or oscillator located in a box 24 is connected by a transmission line 26 to an electromagnetic signal radiating antenna illustrated as a horn 28. Horn 28 is located adjacent aperture 20 in conductive sheet 18 and is arranged for directing electromagnetic energy toward rear wall 14.

An antenna under test (AUT) is located between rear wall 14 and aperture 20 for receiving electromagnetic energy from horn 28. The AUT is mounted on a pedestal 30 for rotating the AUT about an axis 32 of the pedestal, and the AUT is connected by way of a conductor 34 passing through a hole 33 in floor 12 to a receiver 36 connected to a chart recorder 38 which generates plots of the power received by AUT as a function of rotation about axis 32. Receivers and chart recorders are standard commercial products.

Interposed between the antenna under test and conductive sheet 18 is a controllable reflector designated as 40. Controllable reflector 40 is formed as a two-dimensional stack of a plurality of individual controllable reflector-transmitter units, some of which are designated 40*a*, 40*b* . . . in FIG. 1. For simplicity, the controllable reflector-transmitter units are designated individually as 40*n*. Each individual unit 40*n* of controllable reflector 40 is controllable for either reflecting or transmitting electromagnetic energy over a range of frequencies. Each controllable reflector element 40*n* is controlled by a signal coupled thereto from a control circuit illustrated as a box 42. Control circuit 42 as illustrated in FIG. 1 is connected by a bundle 44 of individual transmission lines which extend through the structure of controllable reflector 40 to make contact with each individual controllable reflecting-transmitting unit 40*n*.

Figure 2A:
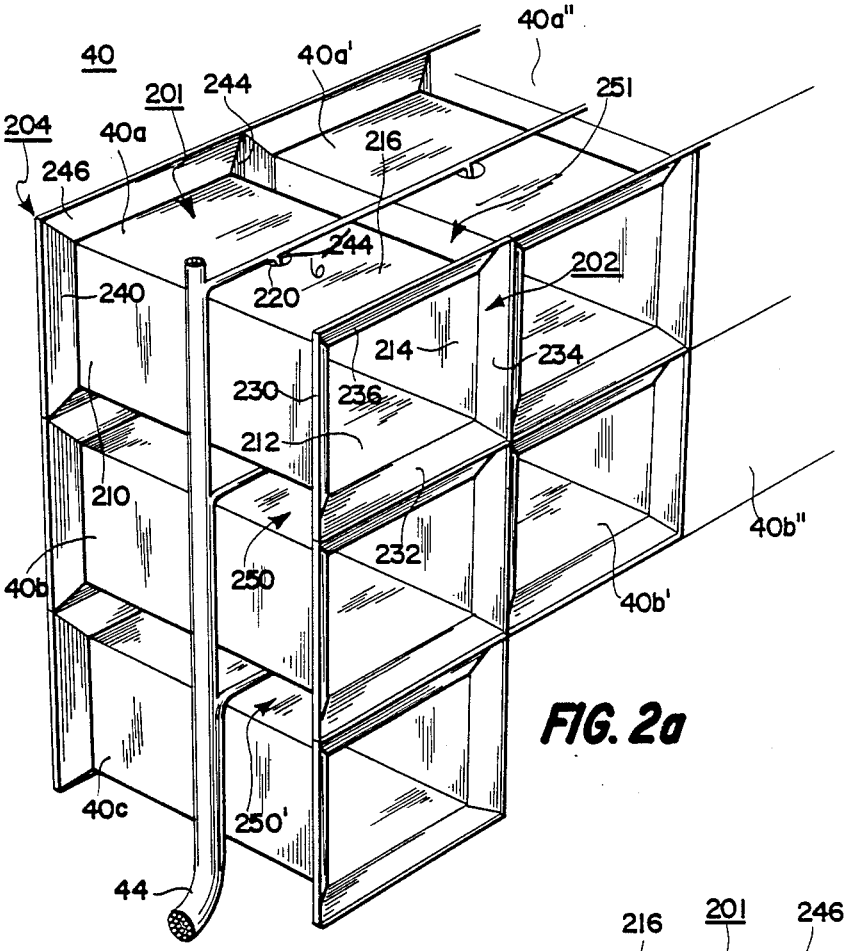
Figure 2B:
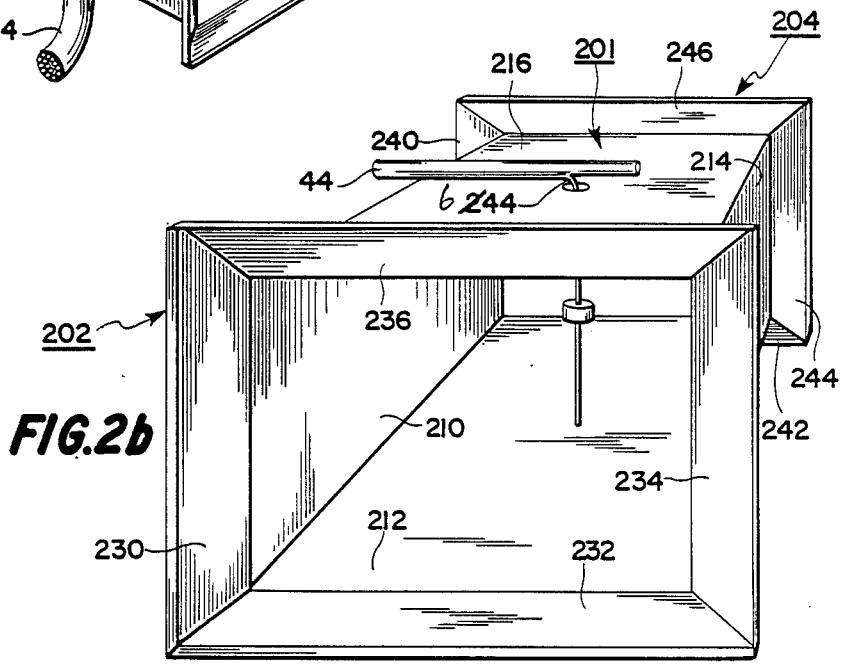

FIG. 2 illustrates details of controllable unit 40*a*, which is representative of all units 40*n*. As illustrated in FIGS. 2*a* and 2*b*, controllable unit 40*a* includes an individual segment of waveguide 201, defined by four plane conducting walls as known in the art. The four conducting walls of waveguide 201 associated with individual controllable reflector-transmitter unit 40*a* are 210, 212, 214 and 216. Conductive top wall 216 defines an aperture 220 centered between walls 210 and 214 by which an individual transmission line 644, which is part of bundle 44, may control the reflective characteristics of controllable unit 40*a*.

Waveguide 201 defined by conductive walls 210, 212, 214 and 216 may be square or rectangular. If only a single electric field polarization is to be used for testing the AUT, the electric field may be polarized vertically, in which case the waveguide sections 201 defined by the conductive walls 210–216 may be a conventional rectangular waveguide wherein walls 210 and 214 are narrow and walls 212 and 216 are wide. In order to provide channels through which transmission line bus bundle 44 and its branches may pass to obtain access to all of the individual reflecting units 40*n*, the extreme ends of the waveguides 201 are flared into short horn sections. The horn sections associated with individual controllable reflection unit 40*a* are designated generally as 202 and 204 in FIG. 2. Horn section 202 is defined by wall sections 230, 232, 234 and 236, thereby associating the last digits of the reference numerals of the walls of the waveguide and associated walls of horn 202. Horn 204 has walls 240, 242, 244 and 246, and the last digits of the reference numbers are similarly related. The edges of the horns 202, 204 at the extremes of each controllable reflective element 40*n* butt together in the stack of controllable reflector 40 as best illustrated in the cross section of FIG. 2*c*, thereby separating the waveguide sections 201 and defining horizontal channels, which are illustrated in FIG. 2*a* as 250, 250′ . . . , and vertical channels, one of which is illustrated as 251, lying between the waveguides of the stack. The branches of transmission line bundle 44 extend through channels 250 and 251 as necessary so as to provide control to all individual reflective elements 40*n*.

FIG. 2*c* illustrates a cross-section of individual reflective element 40*a*. In FIG. 2*c*, a control element in the form of a PIN diode 260 is located within the waveguide and has one electrode connected by a thin conductive wire 262 to lower wall 212. Another conductive wire 264 is connected to a second electrode on the upper side of diode 250, and passes through aperture 220 in upper wall 216 without making contact with wall 216. A dielectric washer (not illustrated) may be used to insure insulation. A thin dielectric film illustrated as 256 lies on the upper surface of wall 216 adjacent aperture 220. Wire 264 bends at a location adjacent aperture 220 and passes across and in intimate contact with the upper surface of film 256. Wire 644 (a branch of bundle 44) makes electrical contact with wire 264 at a location 266. The physical structure illustrated in FIG. 2*c* corresponds to the schematic illustrated in FIG. 2*d*. The arrangement of dielectric film 256 in conjunction with wire 254 forms a capacitor, which in FIG. 2*d* corresponds to symbolic capacitor 265. Those skilled in the art will recognize the arrangement of FIG. 2*d* as one in which a bias voltage having a positive polarity with reference to ground may be applied by way of wires 644 and 264 to forward-bias PIN diode 260 and thereby render it conductive. Capacitor 265 couples wire 264 to wall 216 so that, for frequencies within the range propagated by waveguide 201, wire 264 appears to be connected to wall 216. Capacitor 265 also tends to prevent radio-frequency signals which may be coupled onto wire 264 from being coupled onto wire 644, thereby aiding in preventing erratic operation and attenuation of the signals being propagated toward the antenna under test.

As illustrated in FIG. 2*c*, diode 250, and its associated connecting wires 262 and 264, are located at a distance from the mouth of horn 202 defined by $N\lambda/4$, where N is an odd integer. Ordinarily, the value of N is unity, for maximum bandwidth. As is well known to those skilled in the art, the specified dimensioning tends to prevent electromagnetic signal propagating from right to left in FIG. 2*c* from entering waveguide 201 and horn 202 when PIN diode 250 is forward-biased. That propagating energy which is prevented from entering horn 202 and the associated waveguide is reflected. Consequently, when PIN diode 250 is forward-biased so as to approximate a short-circuit, individual controllable reflector-transmitter unit 40*a* is in a reflecting state. By extension, if all of the PIN diodes of all of the individual units 40*n* of controllable reflector 40 are in their forward-biased state, reflector 40 is in its reflecting condition.

Conversely, when PIN diode 250 of individual unit 40a is not forward-biased or is reversed-biased, it does not affect the flow of signal, so that an electromagnetic signal travelling from right to left as viewed in FIG. 2c may enter horn 202 and waveguide 201, and progress through the waveguide past PIN diode 250 to exit from horn 204. Thus, when the PIN diodes of the individual units 40n are unbiased or reverse-biased, controllable reflector 40 is in its transmissive condition.

FIG. 3 is similar to FIG. 2c, but illustrates control of diode 260 by means of light from a fiber optic transmission line rather than by a direct voltage. Elements of FIG. 3 corresponding to those of FIG. 2 are designated by the same reference numerals. In FIG. 3, conductive wire 264 is mechanically and electrically connected to wall 216. A fiber optic transmission line or cable 344, which is part of bundle 44, extends through aperture 220 and is connected to PIN diode 250 in such a fashion that light passing through fiber 344 is directed onto the active portion of the PIN diode. PIN diodes coupled to optical fibers for control of the conductivity thereof are well known in the art, and are described for example in U.S. Pat. No. 4,675,628 issued June 23, 1987 to Rosen. Thus, when light is applied from control circuit 42 of FIG. 1 through transmission line bundle 44 to bias PIN diodes such as PIN diode 260 of FIG. 3, the PIN diode becomes conductive just as if it were forward-biased by a voltage, and thereby tends to cause reflection of electromagnetic energy propagating from right to left toward horn 202. When diode 260 has no light falling on its active region, it creates a transmissive condition of the unit as described in detail above.

In operation of the arrangement of FIG. 1, control element 42 causes oscillator or transmitter 24 to produce a pulsed oscillation having a defined oscillation frequency and pulse duration. The pulsed oscillation is propagated by way of horn 28 through aperture 20 in conductive sheet 18, so that an expanding sphere of energy is introduced into the region between plane reflector 18 and controllable reflector 40, and progresses toward reflector 40. At the same time, control unit 42 controls the individual reflective units 40n so as to render them reflective, whereupon controllable reflector 40 is in its reflective condition.

The pulse of energy expands with a spherical wavefront toward controllable reflector 40, and is reflected therefrom. During this time, transmitter 24 continues to produce the pulse of energy. At the time at which the leading edge of the spherically expanding wavefront returns from a first reflection by controllable reflector 40 and arrives at conductive sheet 18, the pulse of energy emitted by horn 28 ends. At the instant at which the pulse of emitted energy ends, the space between controllable reflector 40 and sheet reflector 18 is "filled" with the energy pulse; the leading edge of the pulse progressing to the right from reflector 40 toward reflector 18 and just beginning to impinge upon reflector 18, and the trailing half of the pulse travelling from right to left from aperture 20 toward reflector 40.

Following introduction of the pulse into the space between reflectors 18 and 40, multiple reflections take place.

As the energy reflects and re-reflects between controllable reflector 40 and sheet reflector 18, the wavefront becomes more planar, just as though it were a portion of a wavefront propagating in an open-air antenna measuring range. After a sufficient number of reflections, control circuit 42 simultaneously renders all the individual controllable reflector-transmitter units 40n transmissive to thereby render controllable reflector 40 transmissive. At the moment at which controllable reflective element 40 becomes transmissive, that portion of the energy in the space between reflectors which was travelling toward reflector 40 begins to pass therethrough rather than being reflected, and that portion of the energy previously travelling toward the right continues to travel toward the right, is reflected by sheet reflector 18 and returns toward now-transmissive controllable reflector 40, to follow the remainder of the energy therethrough to impinge upon the antenna under test.

The antenna under test receives the pulse of electromagnetic energy and couples it by way of cable 34 to receiver 36, which converts the signal to baseband and applies the baseband signal to chart recorder 38. As soon as one pulse has been transmitted by reflector 40, control circuit 42 once again returns controllable reflector 40 to its reflecting condition and initiates the generation of another pulse of energy by transmitter 24. The pulses of energy produced by transmitter 24 cannot recur more often than the total cycle time as so far described. However, even if the number of reflections were selected to simulate a total path length of about one mile (about 1½ km) the total elapsed time for generation of a pulse and multiple reflections would not exceed about 10 μS. Thus, even for a one-mile effective path length, pulses could recur at a rate of about 100 KHz.

The antenna under test may be rotated on pedestal 30 at a rate such as 1 rpm, while receiving pulses of energy at the 100 KHz rate which have a wavefront which appears to be emitted from a point source at a distance of one mile. This results in the capability of reception and plotting of the antenna response at approximately six million points in one 360° sweep, which is well in excess of ordinary requirements. Naturally, the antenna may be rotated more rapidly or more slowly as required, and other pulse rates may be used.

Figures 4, 5:
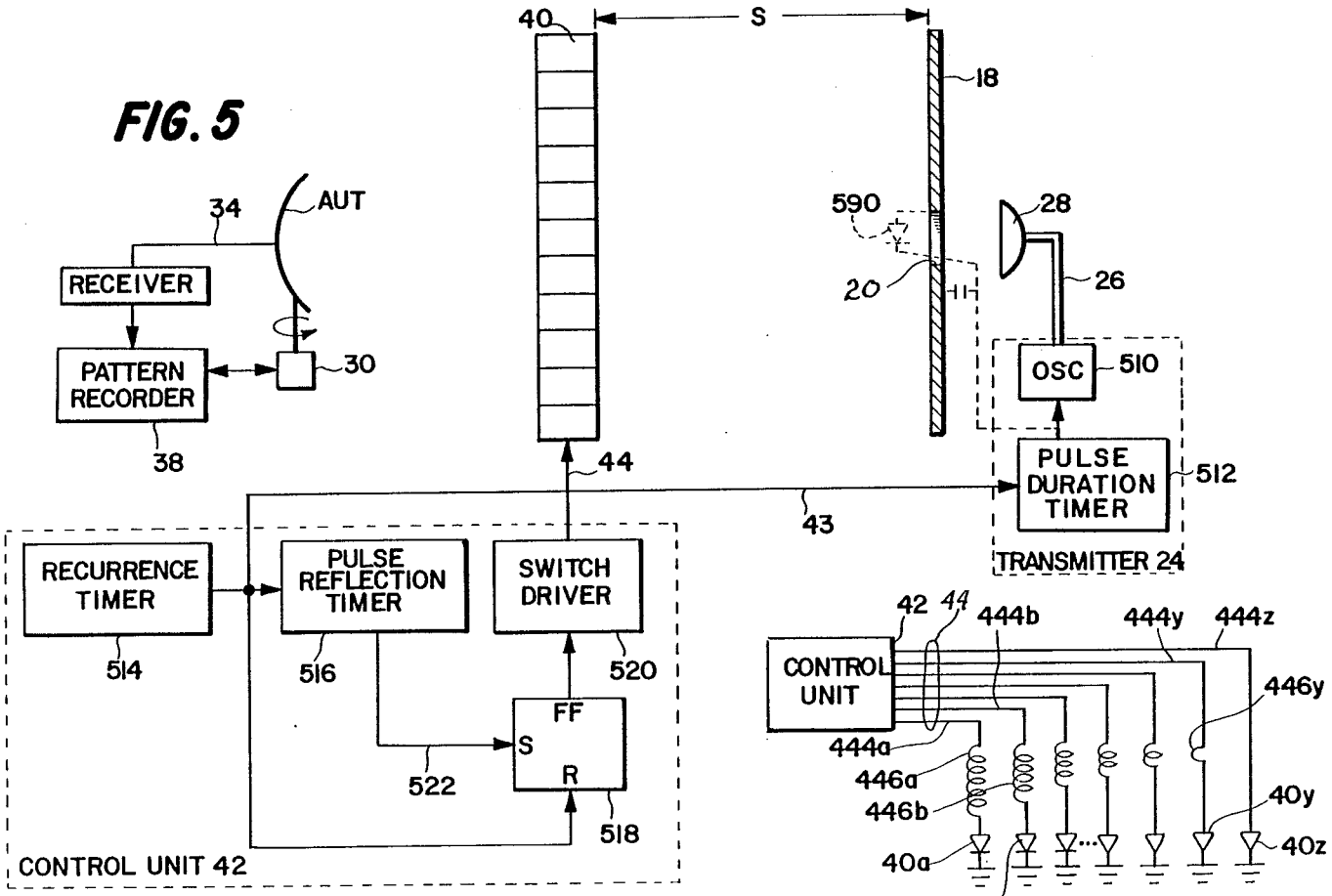
FIG. 4 illustrates the principle of delay of the control signals for the various diodes by means of delay lines which depend upon the distance between the diode and the control circuits in order to obtain simultaneous switching.
FIG. 5 is a block diagram of the arrangement of FIG. 1, illustrating details of the control and signal generation circuits.

As mentioned, all the individual controllable reflective elements 40n of controllable reflector 40 are switched from their reflective state to the transmissive state simultaneously. The timing errors due to path length differences between control element 42 and the various individual controllable reflective elements 40n are corrected by equalization of the cable lengths. As illustrated in FIG. 4, the PIN diode 40z of a column of individual controllable units 40n (units not separately illustrated in FIG. 4) is at the greatest distance from control unit 42. A transmission line including a conductor 444z connects from control unit 42 to PIN diode 40z. Another PIN diode 40y is somewhat closer to control unit 42, and is connected thereto by a conductor 444y which includes a loop 446y to make the total length of conductor 444y equal to that of 444z. Similarly, PIN diodes 40a and 40b are close to control unit 42, and are connected thereto by conductors 444a and 444b, respectively, each of which includes its respective coil 446a, 446b sufficient to make the total length of 444a and 444b equal to the lengths of conductors 444y and 444z, respectively. In this fashion, signals applied from control unit 42 simultaneously to conductors 444a–444z arrive simultaneously at their corresponding PIN diodes 40a . . . 40z, for simultaneously rendering them conductive.

The same principle may of course be used for fiber optic cables.

FIG. 5 is a block diagram of the arrangement illustrated in FIG. 1, including details relating to control unit 42 and transmitter 24. As illustrated in FIG. 5, transmitter 24 includes a controllable oscillator 510 which may produce pulses of oscillations at a test frequency, such as 10 GHz. A triggerable pulse duration timer 512 receives command signals over conductor 43 from control unit 42 for initiating an ON period during which oscillator 510 produces 10 GHz oscillations. Timer 512 may be, for example, a multivibrator. The duration of the ON period produced by timer 512 is less than or equal to the time required for electromagnetic energy to make a round trip from aperture 20 in reflector 18 to controllable reflector 40 and back.

Control unit 42 includes a recurrence timer 514 which recurrently initiates generation of a pulse for application to the antenna under test. The signals produced by recurrence timer 516 (at an exemplary rate of 100 KHz) are applied over conductor 43 to transmitter 24 to begin initiation of a transmitted pulse, and are also applied to a pulse reflection timer 516 to begin initiation of a counting period, and to the R input of an RS flip-flop (FF) 518 for resetting thereof. In its reset condition, FF 518 applies a signal to a switch driver 520 to switch it into a drive condition which renders controllable reflector 40 reflective. Controllable reflector 40 thereafter remains reflective until FF 518 is set after a predetermined period of time. Pulse recurrence timer 516 counts for a predetermined interval selected to equal a predetermined number of reflections of the electromagnetic energy between sheet reflector 18 and controllable reflector 40, plus the time required for the pulse to pass through controllable reflector 40. At the expiration of the interval, timer 516 times out and a signal is applied over conductor 522 to the S input of FF 518 to set the flip-flop and thereby set switch driver 520 to a state which renders controllable reflector 40 transmissive. The system is then ready to once again be triggered by recurrence timer 514.

The duration of the time counted by timer 516 must be shortened by the time required for propagation from switch driver 520 until operation of controllable reflector 40, which as mentioned in conjunction with the discussion of FIG. 4, requires a propagation time at least equal to that required for signals to flow from control unit 42 to the most distant controlled element. Also, it is desirable for timer 516 to count a time selected to render controllable reflector 40 conductive upon the arrival at the reflector of the leading edge of the pulse (as opposed to a random point within the pulse) produced by transmitter 44. This helps to prevent changes in phase of the oscillations of the pulse during reception thereof.

Each time the reflected wavefront impinges on conductive plate 18, a portion of the energy enters aperture 20 and antenna 28 and is lost or re-reflected with a phase shift, which causes attenuation or distortion, or both. This may be avoided by placing one or more diodes 590 across aperture 20 generally as described in conjunction with FIGS. 2c or 3, and forward-biasing diode(s) 590 by means of the output of pulse duration timer 512, as suggested by the dashed lines in FIG. 5, during those times in which oscillator 510 is OFF, and unbiasing or reverse-biasing diodes 590 during those times when oscillator 510 is ON.

The arrangement as so far described can be used with electromagnetic energy in which the electric field is polarized parallel with the direction of wires 262 and 264 of the shorting diode as illustrated in FIG. 2c, which is a vertical polarization in the arrangement of FIG. 1. It may be desirable to operate in the same manner with horizontally polarized energy or with elliptical or circular polarization. This may be readily accomplished by making the waveguides of each individual unit 42 square rather than rectangular, and by providing a second controlled PIN diode and associated supporting conductors orthogonally oriented relative to PIN diode 260 and its supporting wires 262, 264 as illustrated by phantom diode 290 and conductors 294 in FIG. 2c. The wires of the diodes are so thin that both sets may be located essentially $\lambda/4$ from the mouth of horn 202. Naturally, diodes 260 and 290 must be controlled simultaneously.

Those skilled in the art will understand that the switching element may be other than a PIN diode, as for example a PN or thermionic diode, a bulk semiconductor switching element or the like. While ordinary rectangular waveguide has been described, ridged, circular or other waveguide types may be used. Each individual waveguide of a controllable reflective element 40*n* may include an amplifier, as generally described in U.S. Pat. No. 4,677,393 issued June 30, 1987 to Sharma. If light-controlled diodes are used as described in conjunction with FIG. 3, it may be desirable to use a dark radome over the end horns 202, 204 of each individual unit 40*n* to prevent stray light from causing a partial diode bias. While the duration of the pulsed oscillation produced by transmitter 24 has been described as equal to that of a round trip between reflectors, shorter times may be used if desired. While antenna 28 has been illustrated as separate from conductive sheet 24, it may be a horn, the mouth of which is in contact with the periphery of aperture 20.

The arrangement described is applicable for testing antennas over a wide range of frequencies in a single facility—e.g., satellite communications in the 4 & 6 GHz or in the 10 & 12 GHz bands, radars in the L, X or K bands, TV antennas in the VHF and UHF bands, and the like.

What is claimed is:

1. An arrangement producing a substantially planar electromagnetic wavefront, comprising:
   - first and second mutually parallel spaced-apart plane electromagnetic reflecting means;
   - means for introducing a pulse of electromagnetic energy, having a duration less than that required for a round trip between said first and second reflecting means, into the region between said spaced-apart first and second reflecting means; and
   - controllable means for controllably rendering at least one of said first and second reflecting means transmissive rather than reflective beginning at a predetermined time after introduction of each said pulse.

2. An arrangement according to claim 1, wherein said means for introducing electromagnetic energy comprises an aperture in one of said first and second reflecting means, in combination with antenna means coupled to said aperture for radiating said electromagnetic energy into said region between said spaced-apart first and second reflecting means.

3. An arrangement according to claim 1 wherein said electromagnetic energy is in a form including an amplitude step occurring at a reference time, and said controllable means includes timing means for rendering said one of said first and second reflecting means transmissive at a predetermined time after said reference time.

4. An arrangement according to claim 1 wherein at least said one of said first and second reflecting means comprises:

a plurality of mutually parallel open-ended electromagnetic waveguides; and controllable electromagnetic short-circuiting means associated with each of said waveguides.

5. An arrangement according to claim 4 wherein at least some of said waveguides comprise hollow electrically conductive channels through which electromagnetic energy can flow, and each of said controllable short circuiting means comprises switch means coupled within said channels and physically oriented parallel with a direction of polarization of the electric field component of said electromagnetic energy.

6. An arrangement according to claim 5 wherein said channels of said waveguides have a rectangular cross-section including first and second electrically conductive wide walls spaced apart by first and second conductive narrow walls, and said short-circuiting means are electrically connected to points along said first and second wide walls.

7. An arrangement according to claim 6 wherein at least some of said points along said first and second wide walls are located equidistant from said first and second narrow walls.

8. An arrangement according to claim 6 wherein said short-circuiting means comprises a diode.

9. An arrangement according to claim 4 wherein said electromagnetic energy is in the form of a pulse initiated at a reference time and having a time duration which is shorter than the time duration required for said electromagnetic radiation to make a round trip between said first and second reflecting means.

10. An arrangement according to claim 9 wherein said controllable means renders said one of said reflecting means transmissive at a predetermined time after said reference time.

11. An arrangement according to claim 10 wherein said short-circuiting means comprises switch means associated with each of said electromagnetic waveguides; and said controllable means comprises switch driver means for rendering said switch means conductive at said predetermined time.

12. An arrangement according to claim 11, wherein said switch means comprises a switching diode.

13. An arrangement according to claim 12, wherein said switching diode is a PIN diode.

14. An arrangement according to claim 12, wherein said switch driver means comprises light generating means coupled to said switching diode for rendering it conductive in the presence of light.

15. An arrangement according to claim 12 wherein said switch driver means is a source of direct voltage for generating a bias current which is coupled to said switching diode for rendering it conductive in the presence of said bias current.

16. An arrangement according to claim 1 wherein, for use in illuminating an antenna under test, an antenna mounting stand is positioned adjacent said one of said first and second reflecting means but outside said region between said first and second reflecting means.

17. A method for generating electromagnetic energy with a substantially planar wavefront, comprising the steps of:

propagating electromagnetic energy in a first direction;

reflecting said electromagnetic energy from a first reflection control means so that said electromagnetic energy progresses in a retrograde direction;

reflecting said electromagnetic energy from a second reflection control means so that said electromagnetic energy progresses in said first direction; and causing at least one of said first and second reflection control means to switch at a predetermined time to become transmissive rather than reflective.

18. A method according to claim 17, wherein said propagating step commences at a reference time, and said causing step occurs at said predetermined time following said reference time.

19. A method for generating electromagnetic energy with a substantially planar wavefront, comprising the steps of:

propagating electromagnetic energy in a first direction, said propagating step being recurrent and commencing at a reference time, and including the step of terminating the propagation of said electromagnetic energy at a fixed time following said reference time, the time interval between said reference and fixed time being no greater than a particular length of time;

reflecting said electromagnetic energy from a first reflection control means so that said electromagnetic energy progresses in a retrograde direction;

reflecting said electromagnetic energy from a second reflection control means so that said electromagnetic energy progresses in said first direction, said length of time being the length of time required for said electromagnetic energy to make a round trip between said first and second reflection control means to thereby form a pulse of said electromagnetic energy; and causing at least one of said first and second reflection control means to switch to become transmissive rather than reflective at a predetermined time following said reference time.

20. A method for testing an antenna, comprising the steps of:

propagating electromagnetic energy in a first direction;

reflecting said electromagnetic energy from a first reflection control means so that said electromagnetic energy progresses in a retrograde direction;

reflecting said electromagnetic energy from a second reflection control means so that said electromagnetic energy progresses in said first direction; and causing at least one of said first and second reflection control means to switch at a predetermined time to become transmissive rather than reflective; and receiving said electromagnetic energy with said antenna at a location that is adjacent said one of said first and second reflection control means but not between said first and second reflection control means.

* * * * *